US005123650A

United States Patent [19]

Slauter

[11] Patent Number: 5,123,650

[45] Date of Patent: Jun. 23, 1992

[54] MULTI-PANEL MAZE PUZZLE

[76] Inventor: Gordon H. Slauter, 88 South St., Sparta, Mich. 49345

[21] Appl. No.: 568,761

[22] Filed: Aug. 17, 1990

[51] Int. Cl.[5] ..... A63F 9/06

[52] U.S. Cl. ..... 273/155; 273/110; 273/113

[58] Field of Search ..... 273/153 R, 153 S, 155, 273/108, 109, 110, 113, 117, 118 R

[56] References Cited

U.S. PATENT DOCUMENTS

| | | | |
|---|---|---|---|
| 591,146 | 10/1897 | Stannard | 273/155 |
| 4,509,753 | 4/1985 | Vaughan | 273/110 |
| 4,822,047 | 4/1989 | Treer | 273/113 |
| 4,822,049 | 4/1989 | Biber | 273/110 |

FOREIGN PATENT DOCUMENTS

| | | | |
|---|---|---|---|
| 0105620 | 4/1984 | European Pat. Off. | 273/155 |
| 2135553 | 1/1973 | Fed. Rep. of Germany | 273/155 |
| 2211099 | 6/1989 | United Kingdom | 273/109 |

*Primary Examiner*—Edward M. Coven
*Assistant Examiner*—William M. Pierce

[57] ABSTRACT

A maze puzzle has a plurality of separate discs mounted to be independently rotated about a common shaft, which discs each have a plurality of openings by means of which a ball can pass through the discs from the disc through which it entered to the exit opening at the other end of the puzzle. Some of the openings are radially inclined to transfer the ball radially as well as axially and the hole pattern is so designed that the ball must travel axially back and forth between the top and bottom of the puzzle before it can reach the exit opening.

20 Claims, 7 Drawing Sheets

MULTI-PANEL MAZE PUZZLE

SUMMARY OF THE INVENTION

This invention relates to puzzles and more particularly to a puzzle comprising a plurality of vertically stacked discs, each independently rotatable about a common, central axis with a complex arrangement of openings through each individual disc, such that a passage can be created for an object such as a ball or marble to pass from the top entry opening to the bottom discharge opening utilizing holes in the discs but only after the ball has had to travel radially and to reverse the direction of its vertical path of travel at least once and preferably several times.

FIELD OF THE INVENTION

This invention is a new version of the class of games in which a play piece (hereinafter referred to as a "ball") can pass vertically through a plurality of layers of separately rotatable discs for aligning an opening in the disc below with the opening containing the ball in the disc above so that the ball can make progress through the puzzle. Heretofore, it has been conventional practice to make puzzles of this type with radial or tangential slots in some of discs which will lead the player into a blind passageway requiring him to find his way back to the preceding disc opening and once again try to find the valid opening into which the ball must be passed. This invention adds complicating factors to this type of puzzle.

BRIEF DESCRIPTION OF THE INVENTION

The invention provides a puzzle in which there is only a single path for the ball to succeed in making the passage from one end to the other through the plural layers of the puzzle body. There are, however, a number of blind or unsuccessful passages to create a false sense of progress. The puzzle utilizes not only directional reversals in the path the ball must follow, but also openings through individual discs which are inclined radially thereby shifting the radial position of the bal either inwardly or outwardly. Thus, even in following the successful path through the puzzle, the ball will have to, at least once, trace a route which leads to toward the end of the puzzle opposite from the final discharge opening and, from time to time, have to find paths which shift the ball radially inwardly or outwardly.

DESCRIPTION OF THE PREFERRED EMBODIMENT

Figure 1:
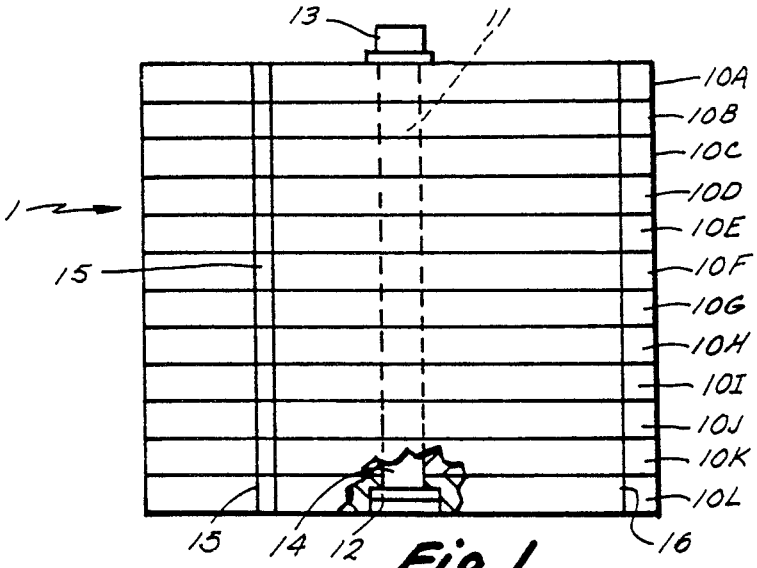
FIG. 1 is a partially broken side elevation view of the puzzle.

The puzzle 1 consists of a plurality of circular discs 10A–10L, each of which has a central opening 11 through which is mounted a rod 14. Preferably, the rod 14 has a head 12 at one end which is recessed into the lower face of the bottom disc (FIG. 1). The arrangement permits the puzzle to be supported on a surface without a destabilizing projection. Preferably, the other end of the rod is so formed that it cannot be removed so that the puzzle is incapable of disassembly. If this feature is not desired, the other end of the rod may be threaded and capped by a washer and nut 13 to hold the discs firmly together but not so firmly that each individual disc cannot be rotated without causing rotation of adjacent discs with which it is in contact. The number of discs depends upon the complexity to be given to the game. The puzzle herein illustrated and about to be described is very complicated since it consists of twelve independently rotatable discs 10A–10L with disc 10A being the top or entry disc and 10L being the bottom or discharge disc. The discs preferably are plastic and can be molded or cut from sheet stock. The discs can be made from transparent material such as styrene or from a pigmented plastic to render them opaque. They can also be made of a translucent plastic. If a transparent or translucent material is used, they can be coated at their outer periphery with an opaque material with each disc having a different color. This latter can be important because it would provide a code for original assembly of the discs or reassembly should they become separated. The importance of this lies in the fact that unless they are arranged in a specific, predetermined order with that face of each disc originally designed to face the disc having the initial entry opening so positioned, they would provide a puzzle which cannot be solved.

Figure 2:
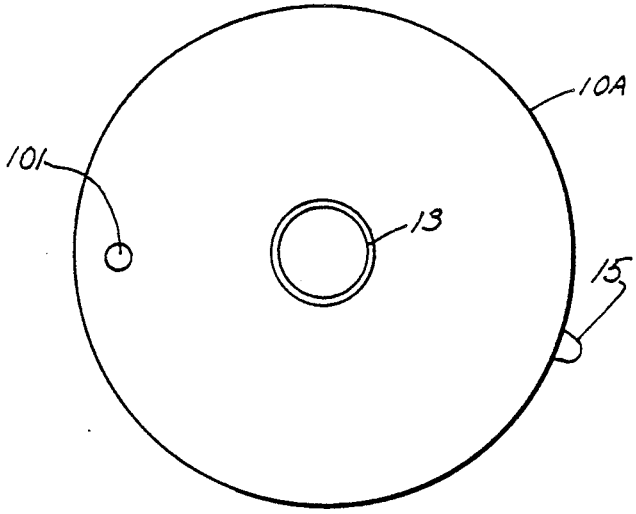
FIG. 2 is a plan view of the puzzle.

It is also advisable to provide a starting indicia, such, for example, as a straight line 16 which extends down the side, the full height of the puzzle to indicate that all discs are aligned to start the puzzle. This would provide a common starting point. Each of the discs can be provided with a small knob 15 which projects from the disc to facilitate rotation of the discs (FIGS. 1 and 2). If the knobs 15 are provided, the line 16 becomes unnecessary and can be omitted. Another possibility is that of making alternate discs transparent and using a ball which is distinctively colored or otherwise visually contrasting, such as a bright red or green ball. A ball bearing can also be used and has the advantage of producing a distinct sound as it is caused to move through the puzzle. A ¼ inch diameter ball has been found to be quite satisfactory when the diameter of the holes is 5/16 inch.

Figure 4:
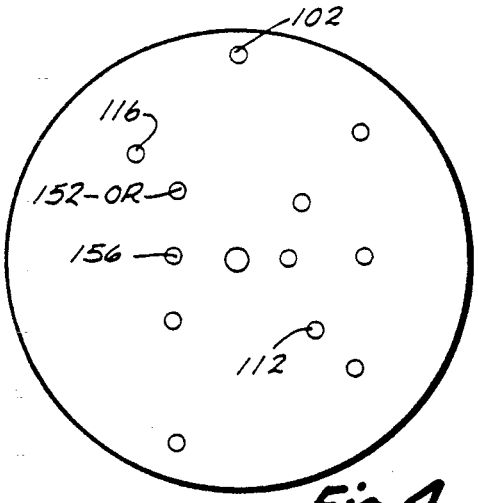
Figure 5:
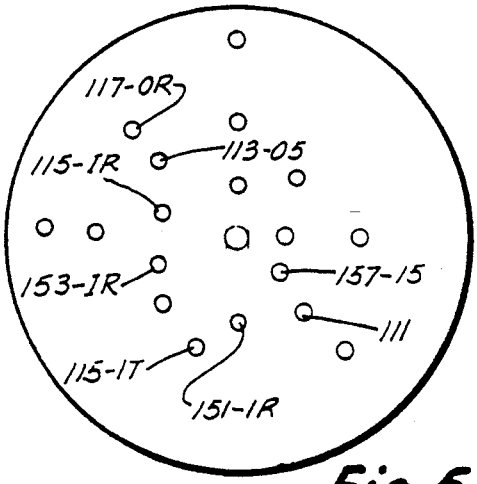

The puzzle is initiated by passing the ball 16 through the first or entry opening 101 in disc 10A (FIG. 2). This is the only ball or player opening in the first disc 10A. By rotating disc 10A, the opening 101 can be caused to align with opening 102 in disc 10B (FIG. 4).

In FIGS. 3–14, the fact of inclination and the radial direction of inclination of the openings is indicated by the letters adjacent the opening number as set out in the following Table I:

| |
|---|
| IR 11° 45' radially inwardly |
| IS 22° 36' radially inwardly |
| IT 31° 58' radially inwardly |
| OR 11° 45' radially outwardly |
| OS 22° 36' radially outwardly |
| OT 31° 58' radially outwardly |

The preceding angles are those found to be operable for a puzzle having an individual disc thickness of 5/16 inch using a ¼ inch diameter ball. It will be recognized that discs can be used having a greater thickness. If this is done, while retaining the same hole and ball diameters, different angles can be used to vary the path the ball must travel to successfully pass through the entire body of the puzzle. This can add to the complexity of the game but does not change the means by which it is rendered complex or the principles of the game's design or mode of operation.

The use of radially inclined openings provides a means of adding complexity as well as variety to the puzzle. The use of such openings of a range of angular magnitudes materially increases the available choices of both variety and complexity which can be incorporated into the puzzle. Combining the concept of radially inclined openings inclined both inwardly or outwardly makes it possible to create a very complex puzzle with less than the twelve discs herein illustrated and described. Thus, the invention provides a puzzle structure capable of a substantial range of challenges. However, the twelve disc puzzle herein illustrated and described is believed to be the best embodiment of the invention.

Figure 15:
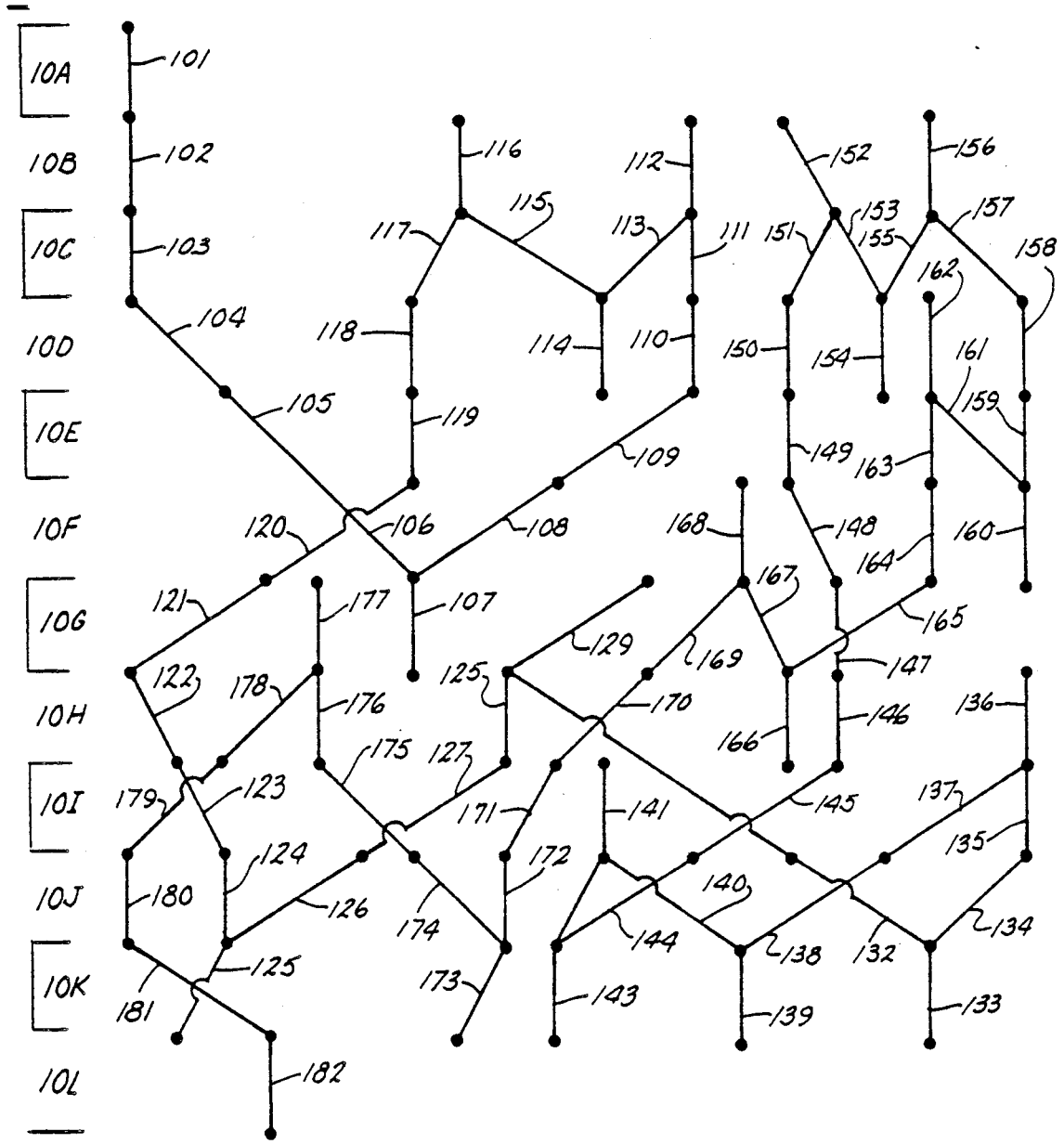
FIG. 15 is a schematic diagram of the path a ball travels to pass through the puzzle.

FIG. 15 diagrammatically illustrates the path a ball must ultimately travel to pass successfully through the entire puzzle body from entry opening 101 to exit opening 184. Where the ball path appears to intersect a path, the ball has already travelled the fact that the paths are circumferentially separated and, thus, do not intersect is indicated by the shape of the path where it appears to intersect. Intersection is avoided because the paths are circumferentially or radially separated. In some cases, they are separated both ways. In FIG. 15 only the correct path is illustrated. This circumferential and radial separation is illustrated in FIGS. 4–14 wherein each of the holes through which the ball must pass and the sequence of its passage for a successful transit of the puzzle are identified by a number which reflects the hole's position in the sequence of the ball's movement through the puzzle. Thus, holes 102, 103 and 105 in FIGS. 4–7 identify sequentially the holes the ball must pass through to successfully and sequentially pass through discs 10B, C, D and E. This pattern of identification is continued through FIGS. 8–14 with the holes sequentially numbered. It will be noted that, except for discs 10A and 10L, the ball must pass a number of times through each disc, even if the ball never deviates from the only path which will result in successful passage through the puzzle.

One of the features of the puzzle is that certain ones of the openings have an axis which is radially inclined to the axis of the rod 13 which serves as a central axis about which all of the discs can be rotated. Certain of these openings are inclined radially inwardly and are identified by a line inclined to the right in FIG. 15. All openings which are inclined to the axis of the puzzle are identified in FIGS. 3–14 by letters as well as numbers. The direction of inclination and the angle of inclination can be determined by reference to Table I. Whether the ball is moving axially toward the exit opening or toward the entry opening can be determined by reference to the drawings in FIGS. 15–18.

Figure 8:
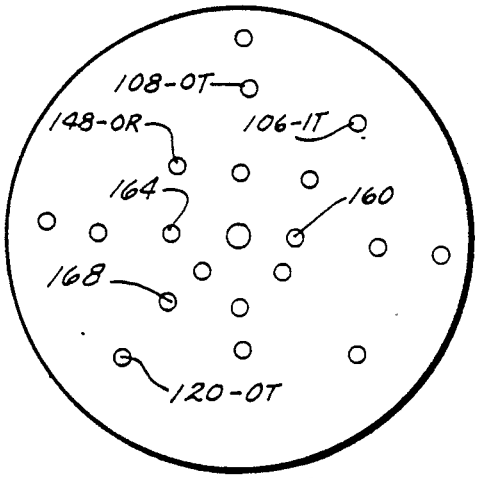
Figure 9:
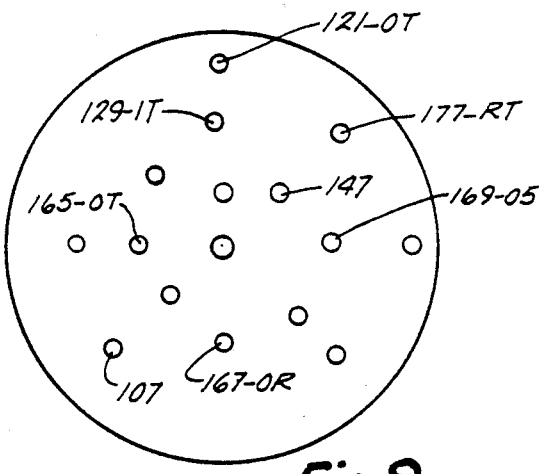
Figure 10:
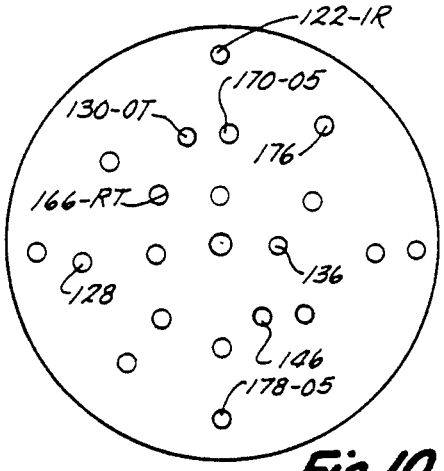
Figure 11:
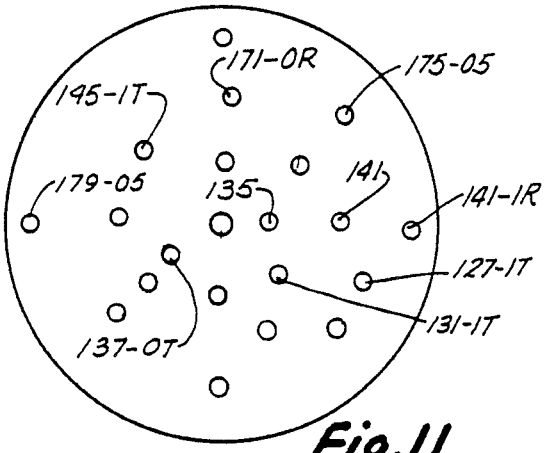
Figure 12:
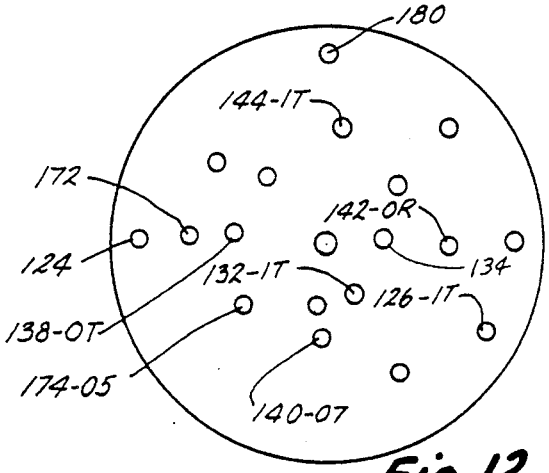
Figure 13:
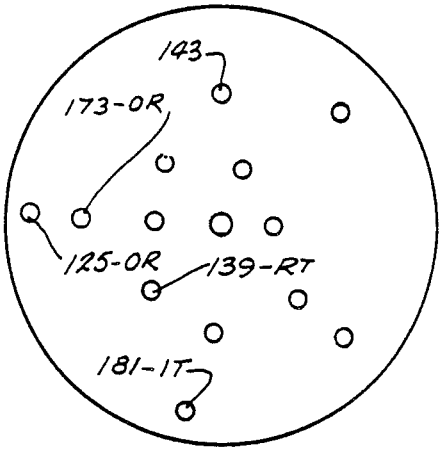
Figure 14:
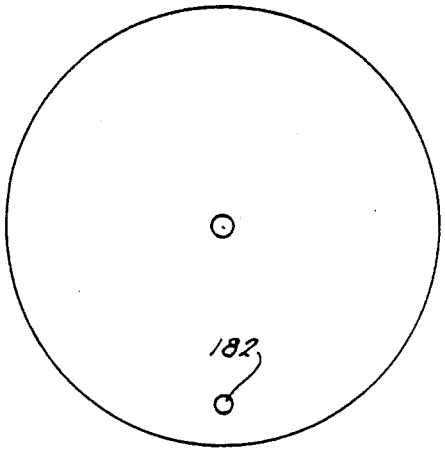

Certain ones of these openings are inclined radially outwardly and are identified by a line inclined to the left as seen in FIG. 15. Thus, for example, it will be seen that openings 101, 102 and 103 pass axially through their respective discs 10A, 10B and 10C. Thus, the path of the ball is parallel to the axis of rotation of the discs. However, in the case of discs 10D, 10E and 10F (FIGS. 6, 7 and 8, the openings 104-IS, 105-IS and 106-IT are all radially inwardly inclined, thus effecting a radially inward transfer of the ball 21. The letters, as indicated by the preceding table, indicate the angle and direction of inclination as set out in the preceding Table I. When the ball is located in the inclined opening 106-IT in disc 10F, this disc must be turned relative to disc 10G until the opening 107 (FIG. 9) aligns with the lower end of opening 106-IT, permitting the ball to pass into opening 107. When the ball 16 is seated in opening 107 in disc 10G, to continue the ball's progress, it is necessary to both invert the puzzle body 1 and carefully rotate either disc 10G or 10F to align opening 107 with opening 108-OT in disc 10F (FIG. 8). Because of the necessity for both inversion and rotation, openings such as 107 may be considered transfer openings. The design of the puzzle as illustrated in FIG. 15 has eighteen additional ones of these transfer openings It will be observed that the puzzle body 1 has to remain inverted to effect transfer the ball through openings 109-IT, 110, 111 and 112 in discs 10E-10B respectively (FIGS. 7, 6, 5 and 4). As the ball passes through openings 108 and 109, it continues its inward radial movement until it reaches opening 110. The ball will then continue its reverse travel through opening 111 until it is seated in opening 112.

Figure 6:
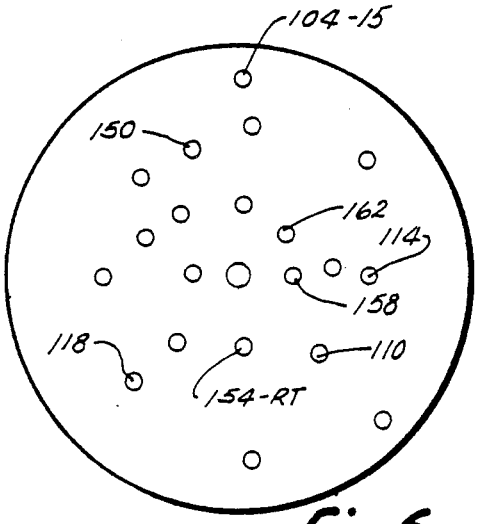
Figure 7:
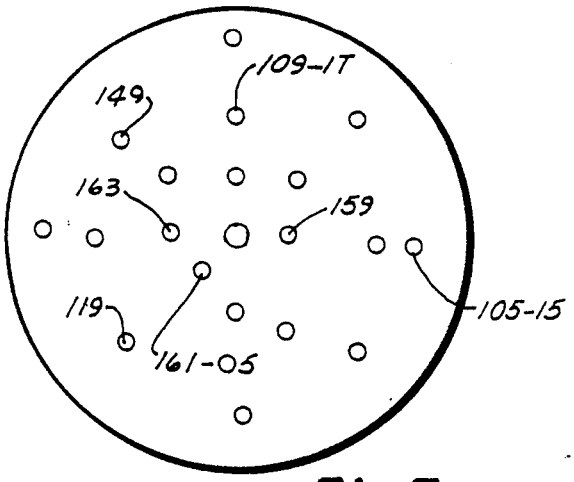

Once the ball is seated in opening 112, the puzzle body 11 is again inverted to assume its original position. Disc 10B is then rotated to find the radially outwardly inclined opening 113-OS (FIG. 5) through which it must pass in a further manipulation of either disc 10C or 10D to enter opening 114 (FIG. 6). Having entered opening 114-RT (FIG. 6), it is once again necessary to invert the puzzle body to cause the ball to pass on through inclined opening 115-IT (FIG. 5) to opening 116-RT in disc 10B (FIG. 4). In this manner, it will be noted that the ball will once again have shifted radially outwardly.

With the ball in opening 116 in disc 10B (FIGS. 4 and 15), the puzzle body is once again returned to its upright position. From opening 116-RT, the ball will then progress downwardly and radially outwardly through openings 117-OR, 118, 119, 120-OT to 121-OT then radially inwardly and downwardly through openings 122-IR and 123-IR, then downwardly through openings 124 and 125-OR (FIG. 15 an FIGS. 5–13). In this leg of its passage through the puzzle, the ball will pass through ten of the twelve discs of the puzzle body. In doing this, its path does not intercept the path 106-IT it has previously travelled through disc 10F because the paths are circumferentially separated as has been previously explained and as will be observed from a study of FIG. 15 in which it will be noted that openings 106-IT and 120-OT are both radially and circumferentially separated and, therefore, non-intersecting. It will also be noted that similar conditions exist where openings 123-IR and 179 and 125-OR and 184-IT appear to intersect. This same observation applies to opening couples 127-175, 130-170, and 131-145, 132-138, 140-144, 147-165 (directional identification omitted).

It will be observed from FIG. 15 that, using the particular hole pattern illustrated, the ball travels the full axial height of the puzzle between the discs 10B and 10K at least three times before reaching the exit opening 185. It will also have made several partial trips axially of the puzzle body. It will be recognized that the complexity of the puzzle can be increased or decreased in several ways. One way is to increase or reduce the number of discs. Another way is to increase or decrease the radial spacing between openings in each disc. The limitation on decreasing the radial spacing is that the ball must not become trapped by an opening in one disc which is sufficiently aligned with the opening containing the ball that the ball, upon entering it, cannot proceed to a point of being totally disengaged from the disc it is leaving and can jam the discs.

The complexity of the game can be changed by using opaque materials for the discs. If such materials are used, the fact of ball transfer from one disc to another can only be audibly detected, requiring a very quiet environment, concentration and patience. In this case, unless the user knows the disc numbers where reversals are to occur, upon entering each new disc the user will have to keep trying to go in the same direction until he either hears the ball transfer or he is satisfied it is not transferring and then inverts the puzzle and listens until he hears the ball transfer. This procedure will require extreme concentration and memorization.

The complexity of the puzzle can be reduced by making every other disc transparent so that the position of the ball can be ascertained by observation, at least, after every other move. If the ball is in a hole of one of the opaque discs, this can be determined if one knows which disc it is in, or if this is unknown, the puzzle can be inverted to cause the ball to retrace its path into a transparent disc. The puzzle can be made even less demanding by making all discs transparent. However, even when this is done, the puzzle will remain difficult and demanding because even with the ball visible to the player, the number of passages in each disc creates great difficulty in determining exactly where the ball is located radially. Further, being able to see the opening containing the ball does not inform the player whether the next opening the ball enters is part of the successful ball path or one of the various false ball paths.

Figure 16:
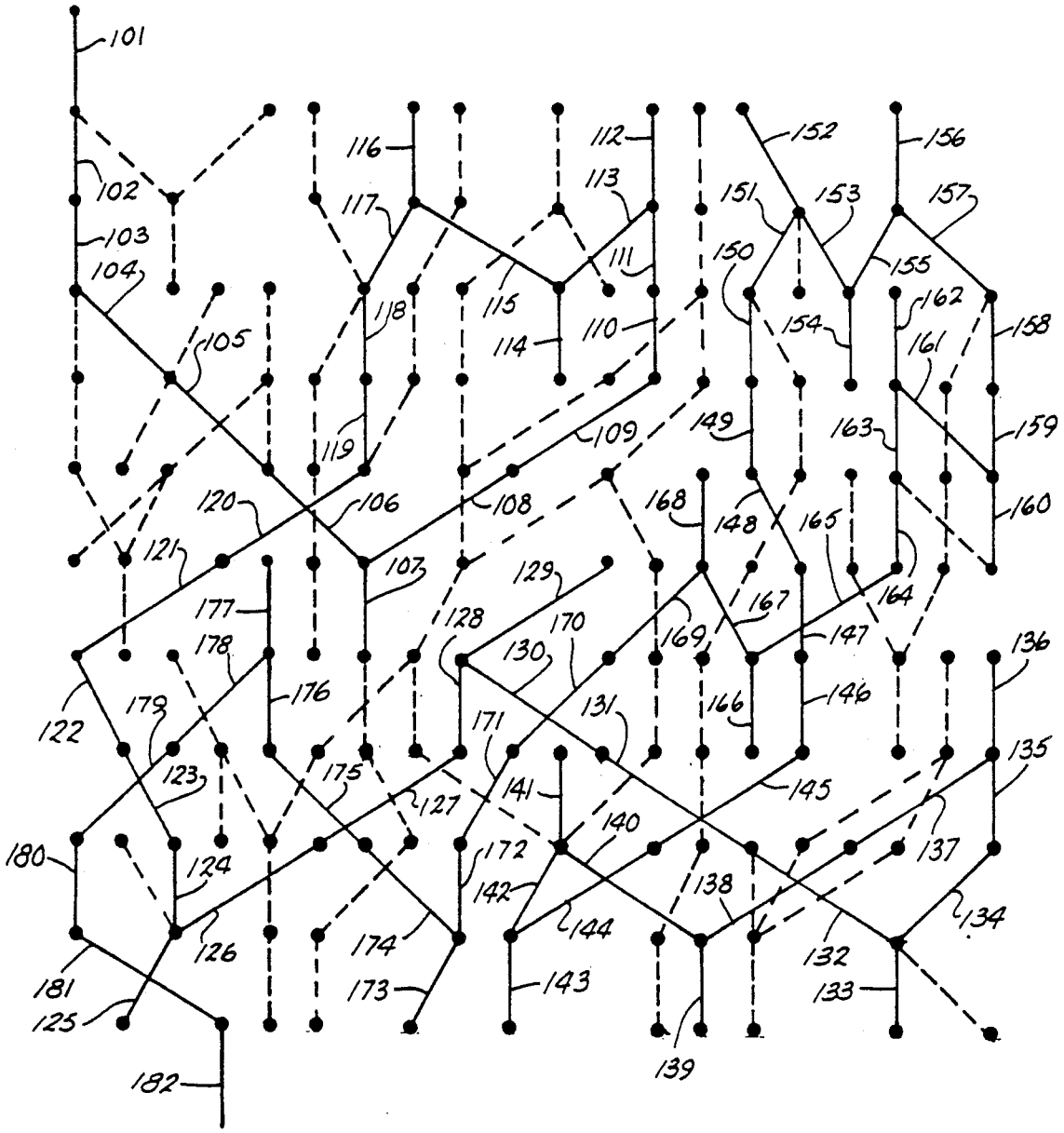
FIG. 16 is the schematic diagram illustrated in FIG. 15 but which also shows in broken lines the false ball passages contained in the puzzle.
Figure 17:
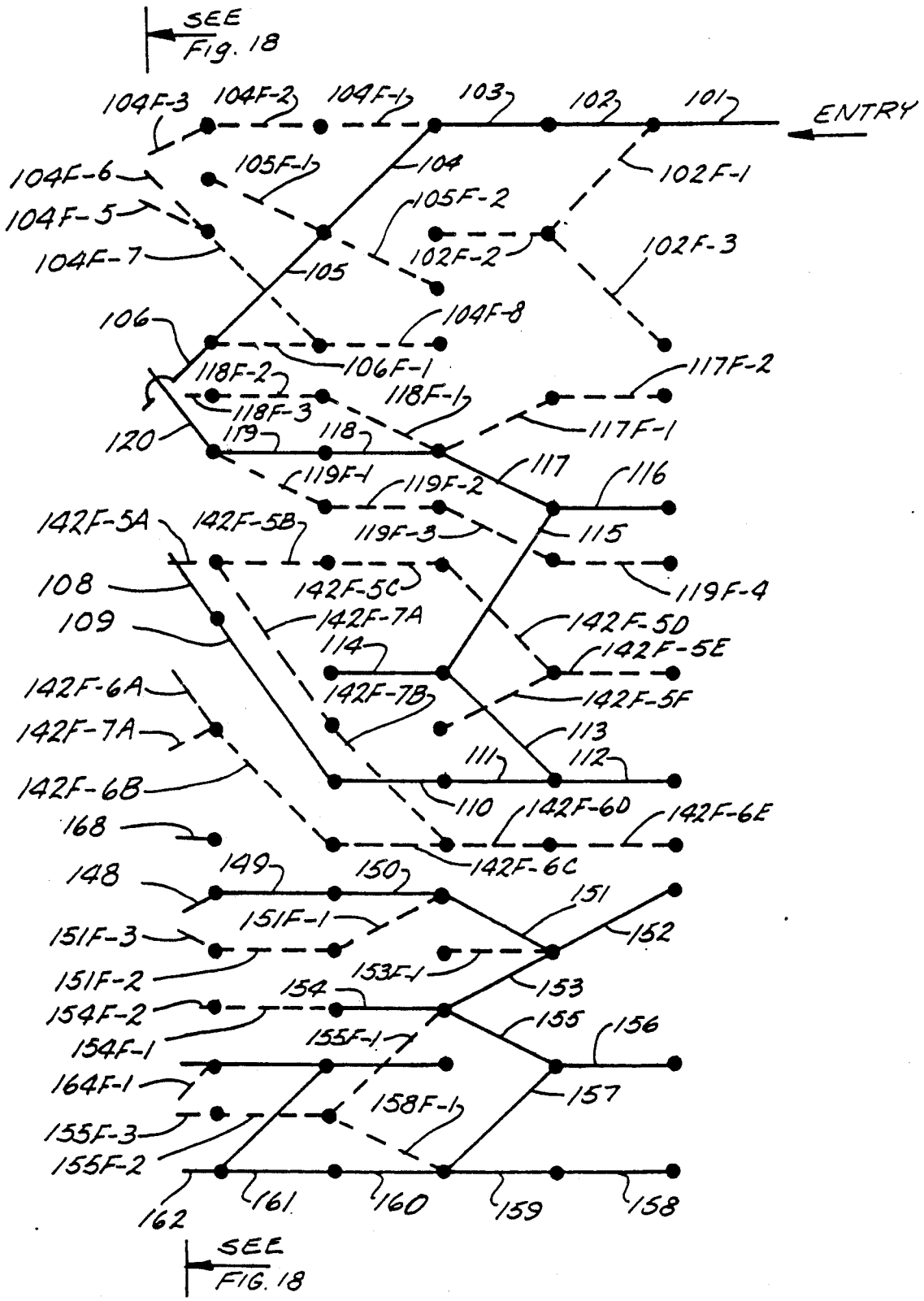
FIG. 17 is an enlarged copy of the upper portion of the ball path illustrated in FIG. 16 in which the false ball paths are identified by broken lines superimposed on the ball path illustrated in FIG. 15.
Figure 18:
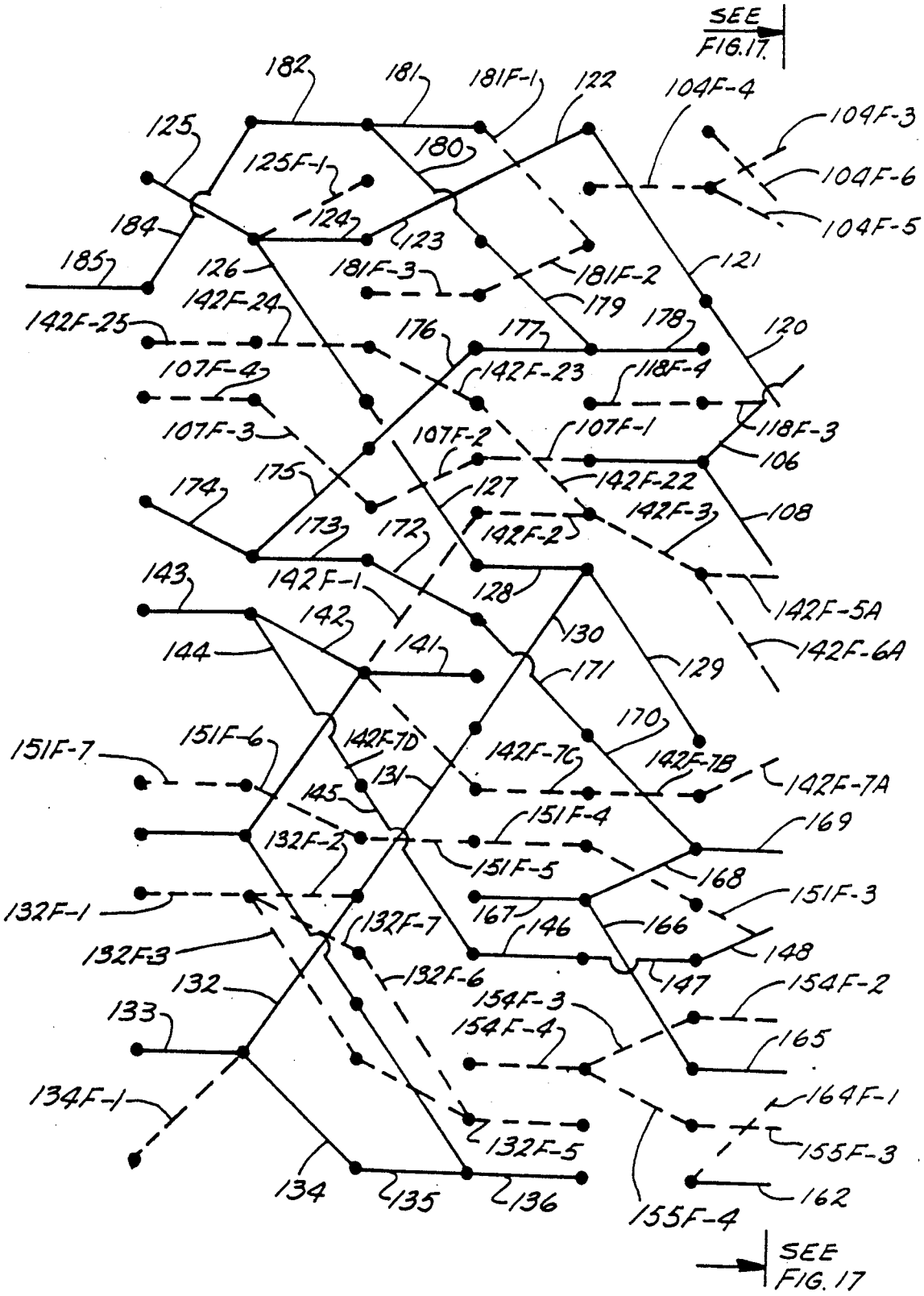
FIG. 18 is a view similar to FIG. 17 but illustrating the lower portion of both the false and true ball paths.

The complexity of the puzzle can be substantially increased by incorporating into the hole pattern and ball path illustrated in FIG. 15 a number of additional paths which the ball might travel only to find that they are blind paths that lead nowhere. In FIGS. 16, 17 and 18, the correct path the ball must travel to reach the exit opening 185 is illustrated in solid lines and is the same as that illustrated in FIG. 15. The false paths which are either blind or return the player to a part of the true ball path which he has already travelled previously are illustrated in broken lines. FIGS. 17 and 18 illustrate, in broken lines and with identification, the false or misleading ball paths incorporated into the puzzle. The false paths are identified by the same number as that of the correct passage the ball would have travelled had it not been diverted. That the path is false is made clear by the added postscript "F" plus a number which identifies the total number of discs the ball travels following the false path before it either reaches a dead end or reenters the correct ball path at some point back or ahead of that at which it entered the false path. The number of the correct path for the ball is also shown in both FIGS. 17 and 18. It will be seen from FIG. 16 that the ball, upon leaving opening 103 in disc 106 can either continue on the correct route through opening 104 into disc 10D or enter the false path that will lead it through discs 10D, 10E, 10F, 10G and then either back to disc C or into disc F or continue the false path back up through the additional discs E and D and then either back through discs 10D, 10E, 10F, 10G, 10F, 10E, 10D into 10C before reentering the proper path. During transit of this path, the ball on the return trip may have entered the blind path 10F which is aligned with 10E. In the case of this path, the ball may enter path 106 in disc 10E to rejoin the correct path and enter leg 106 in disc 10F. However, in doing this, the ball will have travelled a long and difficult path requiring the puzzle to be inverted and again uprighted. This is one of many frustrating alternatives this puzzle provides.

The direction or movement of the ball in the inclined ones or the false paths is omitted from FIGS. 15–18 because of each of adequate space and the direction can be obtained from inspection of the drawings.

The remainder of the puzzle involves a complex of correct and false paths for the ball which utilize the same principles of design and construction. It will be recognized that the complexity which can be designed into the puzzle is limited only by the amount of space available in each disc in relation to the discs adjacent to it to permit effective separation of the various ball paths which are not to form part of either a true or a false path that will positively prevent the ball from entering a path which was never intended by the design of the puzzle.

Since this puzzle uses both radial and axial paths together with both radially inward and radially outward travel with multiple reversions of each of these directions, the magnitude of the puzzle's complexity can be varied through a very wide range by adding more holes in each disc, the limit being that the holes must not interfere with holes in adjacent discs. The complexity can be increased by increasing the diameter of the discs and also increasing the number of the discs.

As previously noted, those of the openings which are radially inclined can be inclined at several different angles. These several angles and the direction of inclination are indicated by the letter adjacent the opening identification. Using a ¼ inch diameter ball and 5/16 inch diameter openings it has been found that those of the openings which are radially inclined are most effective when inclined either 11° 45′, 22° 36′ or 31° 58′. An inclination greater than 31° 58′ is not considered necessary because the diameter of the opening would have to be increased to assure passage of the ball without binding.

The increased radial length of the opening through each side of the disc could result in binding between the ball and one of the openings, especially if the game happened to be inverted and became partially lodged in one of the so inclined openings over which it was passed by the disc in which it is then located and unable to complete the transfer. This difficulty would arise from the greater length in a radial direction of the opening with the plane of the disc surface. Avoiding this would materially restrict the number of radial paths available for the ball in the discs adjacent each face of the disc with such an opening.

Figure 19:
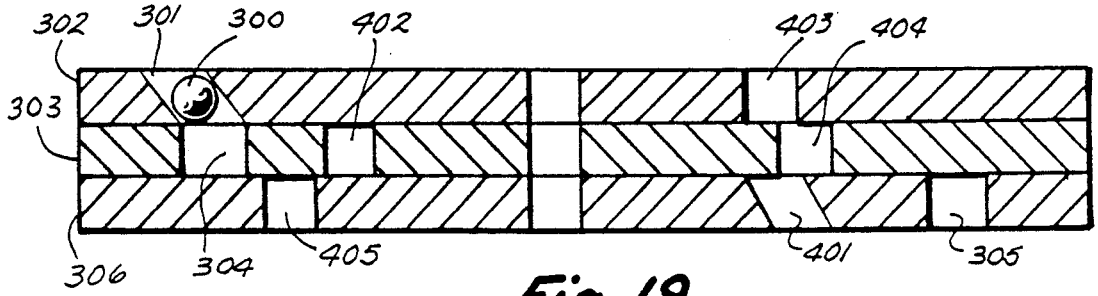
FIG. 19 is an enlarged cross-sectional view of three of the discs illustrating an exemplary relationship of the openings in these discs.

FIG. 19 illustrates an exemplary relation of the openings in three adjoining discs. Assuming the ball 300 has entered opening 301 in disc 302, when that disc is turned until opening 301 aligns with opening 304 in disc 303, the ball will transfer axially and radially inwardly into opening 304 disc 303. When disc 303 is turned, opening 304 will align with opening 305 in disc 306 unless, as disc 301 is turned, opening 304 aligns with another opening 306, an "F" opening before opening 304 reaches opening 305. The "F" opening will not appear in FIG. 19 because it is circumferentially displaced from the plane in which view in FIG. 19 is taken. Assuming, on the other hand, that opening 305 is not the correct path, the ball 300 will, in one manner or another, have to be returned to the correct path before it can be correctly discharged from opening 304. This is diagrammatically illustrated in FIGS. 16–18. FIG. 19 also illustrates another feature of this invention. Assuming the puzzle had been inverted and the ball has entered inclined passage 401, it will enter opening 402 in disc 306 when disc 303 is turned to align these openings. The ball will also then continue to pass on into opening 403 when disc 302 is turned to align that opening with opening 402. Openings 404 and 405 are those which will be used during subsequent passages of the ball through this portion of the puzzle. The preceding description is not intended to describe any particular disc or hole pattern of the puzzle but rather to set forth an exemplary explanation of how the puzzle works. This range of inclination angularity, as set out in Table I, provides a wide variety of radial hole spacings and thus adequate radial spacing for the openings of both the primary and false passageways.

Figure 20:
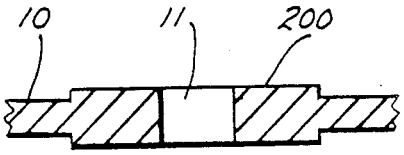
FIG. 20 is an enlarged fragmentary, sectional view of the center portion of one of the discs.
Figure 3:
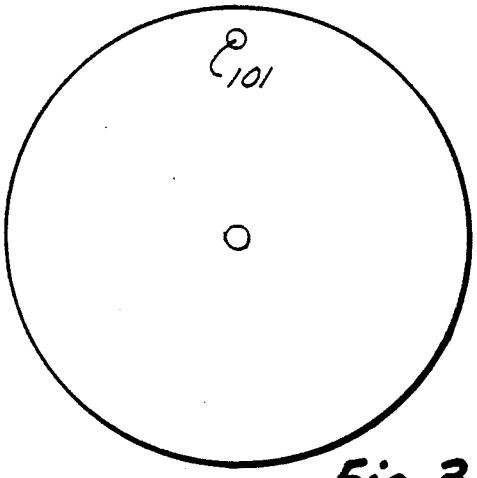
FIGS. 3–14 are plan views, each of which is a view of a different one of the individual discs which, when assembled, form the body of the puzzle.

Further, these angles of inclination provide a sufficient distance of radial transfer the ball to prevent it from partially entering an opening through which it cannot travel and, therefore, interfere with the proper operation of the puzzle. The thickness of the individual discs and the diameter of the ball are factors which have to be considered. However, the ratio of these angles to disc thickness and ball diameter have been found to be satisfactory when the ball has a diameter of ¼ inch, the holes a diameter of 5/16 and the discs are provided with a central washer-like boss 200 of approximately 1/64 inch immediately surrounding the opening for the rod 11. This construction is illustrated in FIG. 20. In lieu of such a boss, a washer of similar thickness and of a suitable material such as a plastic preferably having lubricious characteristics could be substituted. The diameter of the washer must be such that it does not overlap the innermost of the openings for the ball.

Applicant, having described his preferred embodiment of his invention, recognizes that many modifications of his invention can be made. Such modifications as do not depart from the principles of the invention are to be considered as included in the hereinafter appended claims unless these claims, by their language, expressly state otherwise.

I claim:

1. A puzzle having a pair of end discs, one at each end, and a plurality of intermediate discs between said end discs, a central spindle, said discs being rotatably mounted in stacked relationship on said spindle and each capable of rotation about said spindle independently of the other discs with the spindle functioning as the axis of rotation of each disc, each end disc having a single opening therethrough each of which is located intermediate said spindle and the perimeter of the disc; a ball of a diameter to pass freely through said openings, each of said discs having a thickness greater than the diameter of said ball; each of said intermediate discs having a plurality of openings therethrough, each large enough for passage of said ball therethrough, said openings being arranged at different radial distances from said spindle, the axis of certain ones of said openings being inclined to the axis of rotation of the disc whereby the opposite ends of such openings are radially displaced with respect to each other for transferring the ball from one radial path to another, the radial position of the openings in any three adjacent ones of the intermediate discs being such that the opening through the center one of the three discs and containing the ball will axially align with the opening in the disc from which it entered said opening in which it is then located and may align with an opening in the disc opposite from the one from which it entered the opening in the intermediate disc; the arrangement of the openings in the discs being such that the path the ball has to follow may extend axially back toward the end disc through which it entered the puzzle or toward the opening in the end disc opposite from the one through which it entered the puzzle.

2. A puzzle the body of which has a pair of end discs, one at each end, and a plurality of intermediate discs therebetween, a central spindle, said discs being rotatably mounted in substantially stacked relationship on said spindle and each capable of rotation about said spindle independently of the other discs with the spindle functioning as the axis of rotation of each disc, each of said end discs having a single opening therethrough located intermediate said spindle and the perimeter of the disc; a ball of a diameter to pass freely through said openings, each of said discs having a thickness greater than the diameter of said ball; each of said intermediate discs having a plurality of openings each large enough for passage of said ball, said openings being arranged at different radial distances from said spindle, the axis of certain ones of said holes being inclined to the axis of rotation of the disc to permit the ball to move radially of the disc as it passes through it whereby the position of the ball is radially displaced as it is transferred from one disc to another, the radial positions of the openings in any three adjacent ones of the intermediate discs being such that the opening through the center one of the three discs and containing the ball will axially align only with the opening in the disc from which it entered said opening in which it is then located and may align with an opening in the other one of the two discs opposite from the one from which it entered the opening in the intermediate disc; to thereby create a path for the ball, which path may extend axially toward either of the end discs before aligning with the opening in the end disc opposite from the end disc through which it entered.

3. A puzzle the body of which has a pair of end discs, one at each end, and a plurality of intermediate discs therebetween, a central spindle, said discs being rotatably mounted in stacked relationship on said spindle and each capable of rotation about said spindle independently of the other discs with the spindle functioning as the axis of rotation of each disc, the disc at each end having a single opening therethrough each of which openings is located intermediate said spindle and the perimeter of the disc; a ball of a diameter to pass freely through said openings, each of said discs having a thickness just sufficient that the ball will not simultaneously contact both of the discs adjacent the one having the opening containing the ball; each of said intermediate discs having a plurality of openings therethrough each large enough for passage of said ball, said openings being arranged at different radial distances from said spindle, the axis of certain hones of said holes being shaped to permit the ball to move radially of the axis of rotation of the disc whereby the position of the ball is radially displaced as it passes through the disc, the combination of axially aligned hole pairs in adjacent discs and pairs of radially inclined and axial extending holes in adjacent discs forming a ball path which extends both radially and axially of said puzzle body intermediate said end discs, said ball path extending from one end disc to the other more than once in each direction before it reaches the opening in the end disc opposite from the end disc through which it entered the puzzle.

4. A puzzle the body of which has a pair of end discs, one at each end, and a plurality of intermediate discs, a central spindle, said discs being rotatably mounted in stacked relationship on said spindle and each capable of rotation about said spindle independently of the other discs with the spindle functioning as the axis of rotation of each disc, each of said end discs having a single opening therethrough each of which is located intermediate said shaft and the perimeter of the disc; a ball of a diameter to pass freely through said openings, each of said discs having a thickness just sufficient that the ball will not simultaneously contact both of the discs adjacent the one having the opening containing the ball, each intermediate disc having a plurality of openings therethrough large enough for passage of the ball, said openings being arranged at different radial distances from said spindle, at least one opening in certain ones of the discs being inclined with respect to the axis of said spindle, some of said certain openings being inclined radially inwardly and others radially outwardly, the arrangement of the openings being such as to create a path through the intermediate discs which requires the ball to travel in both axial directions between said end discs and both radially inwardly and radially outwardly with respect to the spindle to move through the puzzle between the single opening in the one end disc through which it entered the puzzle body to the single opening in the other end disc.

5. A puzzle the body of which has a pair of end discs, one at each end, and a plurality of intermediate discs between said end discs, a central spindle, said discs being rotatably mounted in stacked relationship on said spindle and each capable of rotation about said spindle independently of the other discs with the spindle functioning as the axis of rotation of each disc, the disc at each end having a single opening therethrough located intermediate said spindle and the perimeter of the disc; a ball of a diameter to pass freely through said openings, each of said discs having a thickness at least that of the diameter of said ball; each of said intermediate discs having a plurality of openings each large enough for passage of said ball therethrough, said openings being arranged at different radial distances from said spindle, the axis of certain ones of said openings being shaped to permit the ball to move radially of the axis of rotation of the disc about the spindle whereby the position of the ball is radially displaced as it is transferred through the disc to an adjacent disc, the combination of axially aligned opening pairs in adjacent discs and pairs of radially inclined and axial openings in adjacent discs forming plural ball paths which extend both radially and axially of said body intermediate said end discs, of the paths formed by holes in adjacent pairs of said discs only one of the hole pairs constitutes a part of the path the ball must travel through the intermediate discs between the openings in the end discs at one end of the puzzle and the end disc at the other end of the puzzle.

6. A puzzle having a body as described in claim 5 wherein each of said discs is fabricated of an opaque material whereby the position of the ball in any of the intermediate discs cannot be observed.

7. A puzzle having a body as described in claim 5 wherein alternate ones of the discs are fabricated of a transparent material and the others of the discs are fabricated of an opaque material.

8. A puzzle having a body as described in claim 5 wherein all of said discs are fabricated of a transparent material.

9. A puzzle having a body as described in claim 5 wherein each of said discs has an opaque perimetral surface whereby the position of the ball cannot be observed.

10. A puzzle having a body as described in claim 5 wherein an exterior line is provided on said puzzle body extending from one end to the other, said line being formed when said discs are rotationally aligned to initiate the game by passing the ball through the single opening in the disc as said one end of the puzzle.

11. A puzzle as described in claim 5 wherein the inclination of those of the holes which are radially inclined being in the range between 11° 45′ and 31° 58′ to the plane of the disc.

12. A puzzle as described in claim 5 wherein certain ones of the inclined openings are inclined radially toward said spindle and others are inclined radially away from said spindle whereby the radial position of the ball is caused to shift in both radial directions as it travels axially of the puzzle.

13. A puzzle as described in claim 12 wherein the hole pattern requires the ball to ravel radially both toward said spindle and away from said spindle more than once in order to move from the entry opening through which the ball entered said puzzle body and the exit opening at the other end of the body through which the ball can exit from of the puzzle.

14. A puzzle as described in claim 12 wherein the hole pattern in adjacent discs is arranged to form a path for the ball which is shaped to require the ball to travel axially from one end disc to the other end disc more than once in order to move from the entrance opening to the exit opening of the puzzle.

15. A puzzle as described in claim 12 wherein the hole pattern requires the ball to travel radially both inwardly toward said spindle and outwardly away from said spindle in order to move from the entrance opening to the exit opening of the body and to travel axially from one end disc to the other more than once in order to move from the entrance opening to the exit opening of said puzzle.

16. A puzzle having a body as described in claim 5 wherein each disc has a radially extending projection whereby the operator of the puzzle body by engaging the projection can rotate the particular disc with respect to all other ones of the discs.

17. A puzzle having a body as described in claim 16 wherein when said discs are rotationally aligned to initiate the game the projections of the discs form a projecting ridge extending axially between the ends of the puzzle body.

18. A puzzle having a body as described in claim 5 wherein each disc has means on its circumference to identify its axial position with respect to all others of the discs in the assembled body.

19. A puzzle having a body as described in claim 18 wherein said means is a different color on each disc.

20. A puzzle having a body as described in claim 18 wherein said means is a different number on each disc.

* * * * *